US006087023A

United States Patent [19]

Tsantrizos et al.

[11] Patent Number: 6,087,023

[45] Date of Patent: Jul. 11, 2000

[54] NEAR NET-SHAPE VPS FORMED MULTILAYERED COMBUSTION SYSTEM COMPONENTS AND METHOD OF FORMING THE SAME

[75] Inventors: Peter G. Tsantrizos, Westmount; George E. Kim, Montreal; Alexander P. Cavasin, Vercheres; Serge Grenier, Montreal, all of Canada

[73] Assignee: Progenesis Inc., Montreal, Canada

[21] Appl. No.: 09/114,893

[22] Filed: Jul. 14, 1998

[30] Foreign Application Priority Data

Jul. 29, 1997 [CA] Canada ..... 2211961

[51] Int. Cl.[7] ..... B32B 15/00; B22F 7/00

[52] U.S. Cl. ..... 428/612; 428/632; 428/633; 428/650; 428/668; 428/678; 428/937

[58] Field of Search ..... 428/612, 632, 428/633, 668, 678, 680, 937

[56] References Cited

U.S. PATENT DOCUMENTS

| | | |
|---|---|---|
| 3,204,917 | 9/1965 | Richards . |
| 3,427,698 | 2/1969 | Guzewicz . |
| 3,467,583 | 9/1969 | Naimer . |
| 5,332,601 | 7/1994 | Varacalle, Jr. et al. . |
| 5,384,200 | 1/1995 | Giles et al. . |
| 5,439,714 | 8/1995 | Mori et al. . |

FOREIGN PATENT DOCUMENTS

| | | | |
|---|---|---|---|
| 2498123 | 7/1982 | France | B30B 15/24 |
| 2559506 | 8/1985 | France | C23C 4/12 |
| 2663872 | 1/1992 | France | B23K 5/18 |
| 4114962 | 11/1992 | Germany | C23C 4/12 |
| WO8505173 | 11/1985 | WIPO | F41C 21/02 |

OTHER PUBLICATIONS

T. McKechnie et al.; "Near–Net Shape Forming of Ceramic Refractory Composite High Cartridges by VPS"; Jun. 20–24, 1994; pp. 457–461; Boston, MA.

T.N. McKechnie et al.; "Metallurgical and Process Comparison of Vacuum Plasma Spray Forming on Internal and External Surfaces"; Jun. 7–11, 1993; pp. 543–548; Anaheim, CA.

H.–D. Steffens et al.; "Mechanial Properties of Vacuum-Plasma Sprayed Titanium and Titanium Alloys"; May 28–Jun. 5, 1992; pp. 369–374; Orlando, Florida.

Patent Abstracts of Japan, vol. 11, No. 159 (C–423), May 22, 1987 & JP 61 288060 A (Sumitomo Electric Ind.), Dec. 18, 1986.

R.J. Quentmeyer, "Fabrication of ceramic substrate–reinforced and free forms by mandrel Plasma spraying metal-ceramic composites", Journal of Vacuum Science & Technology A, vol. 3, No. 6, Nov. 1985–Dec. 1985, pp. 2450–2455, North Carolina, USA.

*Primary Examiner*—Timothy M. Speer
*Assistant Examiner*—Bryant Young
*Attorney, Agent, or Firm*—George J. Primak

[57] ABSTRACT

The invention provides an improved near net-shape VPS formed multilayered combustion system component having an inner surface consisting of a smooth protective thermal barrier coating, and an outer layer of superalloy capable of withstanding temperatures in excess of 700° C. The invention also includes the method of forming such components by first vacuum plasma spraying a suitable mold with a ceramic top coat, followed by a bond coat and followed by a thick structural layer of superalloy. The mold is then separated from the multilayered structure which results in the desired near net-shape component. Combustor liners and transition ducts of gas turbine engines can be advantageously formed in this manner.

10 Claims, 3 Drawing Sheets

NEAR NET-SHAPE VPS FORMED MULTILAYERED COMBUSTION SYSTEM COMPONENTS AND METHOD OF FORMING THE SAME

BACKGROUND OF THE INVENTION

1. Field of the Invention

This invention relates to improved multilayered combustion system components, such as combustor liners or transition ducts of a gas turbine engine, wherein the inner surface comprises a protective thermal barrier coating (TBC), which includes a ceramic top coat and a metallic bond coat, and the outer surface consists of a structural layer bonded to the TBC through the bond coat. The improved qualities of the new components over current components include a superior thermal barrier coating, a better high-temperature structural material, a smoother inside surface, no irregularities (welds) within the component, and excellent reproducibility. This is accomplished by a vacuum plasma spray (VPS) process which is used to form the ceramic top coat layer on a suitable mold, followed by a metallic bond coat layer and ending with a structural superalloy layer. Thereafter, the mold is removed to form the multilayered component of the present invention.

2. Description of the Prior Art

It is accepted practice in the gas turbine industry to provide TBC's consisting of a ceramic top coat and a metallic bond coat (typically an MCrAlY) on the inner surface of preformed combustion system components. Two of the components protected by such coatings are combustor liners and transition ducts, which contain the combustion flame and channel the extremely hot gas (>1,300° C.) to the first stage vanes. The transition ducts in particular have a fairly complex geometry and the presently known technology does not allow for satisfactory coating of internal surfaces of components with such complex geometries.

The current fabrication process of combustion system components, such as combustor liners and transition ducts, consists of: (i) mechanically forming two or more individual sections of the component; (ii) plasma spraying by atmospheric plasma spray (APS) the inner surface of each section to form the thermal barrier coating system; (iii) welding the sections so coated; (iv) plasma spraying by APS the protective TBC coatings on the welds whenever possible; and, for transition ducts, (v) laser drilling cooling holes through the structural wall and the coating. There are several significant problems with components which have been fabricated in this fashion. One problem is the nonhomogeneity at the welds. Weld regions act as weak sites from which failure may initiate due to poor quality finish of both the top coat and the bond coat of the TBC. Also, due to the rough surface of the TBC inherent in the APS process and particularly of the weld regions, an undesirable change in flow pattern of the hot gas is often produced. Moreover, because the current fabricating process consists of mechanically forming sections of the component followed by welding and spraying inner surfaces of these sections, there is a limitation on the choice of suitable superalloys. Only superalloys with high elongation such as, nickel-chromium alloys known under trade names Haynes 230, IN-617, etc. are suitable. Superalloys which do not possess the required elongation or ductility cannot be used with the current fabrication process, even if they possess other superior properties, such as better high temperature strength and creep resistance, e.g. IN-738LC superalloy.

It should be noted that demand on engine performance has increased in recent years for both aero and industrial gas turbine engines. In 1984, the US Air Force created the High Performance Turbine Engine Initiative (HPTEI) in which increasing the combustor and turbine entry temperatures (TET) was a major goal. A similar program known as Advanced Turbine System (ATS) was initiated shortly thereafter by the US Department of Energy (DOE) which envisaged an increase in firing temperatures above 1427° C.

Gas turbine hot-section materials constitute an important limiting factor and are critical to achieving the higher firing temperatures. Current methods of producing closed combustion system components, e.g., combustor liners and transition ducts, to contain and guide the hot gas, have inherent limitations which are difficult to overcome, especially in more demanding conditions, such as higher temperatures and pressures.

OBJECTS AND SUMMARY OF THE INVENTION

It is an object of the present invention to obviate the problems and disadvantages mentioned above and to provide improved multilayered combustion system components through VPS near net-shape forming thereof with a smooth TBC inner layer of predetermined thickness.

Another object is to provide combustion system components which resist high gas temperatures of the order of 800° C.–1600° C.

A still further object of the present invention is to form components with a protective inner TBC, which do not require welding as an integral part of the fabrication process.

Other objects and advantages of the invention will become apparent from the following description thereof.

Essentially the novel components of the present invention are near net-shape VPS formed multilayered combustion system components, such as combustor liners or transition ducts, which comprise:

(a) an inner ceramic top coat of uniform predetermined thickness which resists high gas temperatures and thermal shock during operation within the combustion system, such as a gas turbine engine, and has a smooth inside surface;

(b) an intermediate metallic bond coat of MCrAlY where M is Ni, Co, Fe or a combination thereof, adjacent to the ceramic top coat, which provides protection from high temperature corrosion and oxidation while ensuring good adhesion between the ceramic top coat and an outer structural superalloy; it has a predetermined thickness which is smaller than that of the top coat; and (c) an outer structural superalloy layer formed by VPS on top of the bond coat without any weld regions or nonuniformities in the surface finish that may act as initiation sites for failure of the component, said structural superalloy layer having a predetermined thickness that may vary within the component depending on operating requirements, and is such as to be capable of withstanding temperatures in excess of 700° C.

The ceramic top coat is normally of a thickness greater than 250 $\mu$m and preferably greater than 1 mm. The preferred range of the top coat thicknesses is between 1 and 1.5 mm. It is formed of ceramic materials such as zirconia ($ZrO_2$) and calcia-silica ($Ca_2SiO_4$). $ZrO_2$ may be partially stabilized with yttria ($Y_2O_3$) as is known in the art.

The metallic bond coat is made of MCrAlY where M is Ni, Co, Fe or a combination thereof. For example, CoNiCrAlY is an excellent bond coat material when sprayed to a thickness of between about 100–200 $\mu$m. Such material is already described, for example, in U.S. Pat. No. 5,384,200 of Jan. 24, 1995, where it is deposited as part of a TBC on the surface of combustion chamber components by plasma spray; the components themselves in that case are, however, not formed by plasma spray and furthermore no use of VPS is disclosed.

The near net-shape VPS formed outer structural superalloy layer is normally formed of a nickel-base or cobalt-base superalloy having good structural and thermal resistance properties, such as Inconel, Hastelloy or Haynes Alloy, however, unlike known technology where such alloys had to be mechanically preformed and, therefore, had to possess sufficient elongation and ductility for that purpose; in the present case, any desired superalloy may be employed, since the outer structure is also formed in accordance with the present invention by vacuum plasma spray unlike anything taught by the prior art for such multilayered applications. Thus, a superalloy, such as IN-738LC which has excellent high temperature resistance properties, but is too brittle to be mechanically formed, can now be used within the present invention.

The structural superalloy layer is usually between 1 and 5 mm thick, and should be capable of withstanding temperatures in excess of 700° C. Because it is formed by VPS, it has no seams or welds and it may be deposited to different predetermined thicknesses within the same component, which is very useful for components with complex geometries, such as the transition duct, where it may be desirable to have a thicker structure wall in some areas of the component. Such thicker build-ups may be spray formed, according to this invention, within the same overall operation, i.e. when the entire multilayered structure of the component is being formed. Both the bond coat and the structural layer are normally built-up with dense microstructures, typically less than 1.5% porosity and preferably less than 1% porosity, whereas the top coat will usually be produced with a controlled porosity of between 5 and 20%, (e.g. 10%) to maximize its thermal barrier properties. Furthermore, reinforcing continuous fibers may be incorporated in any of the layers to improve the mechanical properties of the component. This is accomplished by providing a spool within the vacuum plasma spray chamber from which the fibers are fed while deposition of the layers is carried out.

The present invention also includes a method of near net-shape forming by VPS of the multilayered combustion system components described above which comprises:

(a) providing a mold within a vacuum plasma spray chamber, which mold has the shape of the internal surface of the desired component;

(b) heating said mold to a predetermined surface temperature and vacuum plasma spraying said mold with a ceramic top coat of predetermined thickness;

(c) heating the surface of the so produced top coat to a predetermined temperature and vacuum plasma spraying said top coat surface with a bond coat, for example of MCrAlY;

(d) maintaining the surface of the so produced bond coat at a predetermined temperature and vacuum plasma spraying said bond coat surface with a layer of structural superalloy of predetermined thickness, capable of withstanding temperatures in excess of 700° C.; and (e) cooling the structure so produced and removing the mold therefrom, thereby forming the near net-shape multilayered component from inside out in a single overall operation.

The mold may be a destructible mold, which means that after each operation it will be destroyed by removing it, for example, through chemical or electrochemical means. In such a case it is usually made of a soft metal, such as copper, and is used with components of complex geometries from which it cannot be mechanically withdrawn after cooling. On the other hand, with simpler components, such as combustor liners, the mold may be a re-usable mold, in which case it will be made of steel (e.g. stainless steel), graphite or other suitable material which, after cooling is mechanically removed, and which may then be re-used to make further components. Depending on circumstances, the mold may be either solid or hollow. The mold should have a smooth surface, such as to enable VPS forming of components with smooth inside surface, and it should be capable of withstanding and operating at high temperatures.

When re-usable molds are employed, it is preferable to also provide a thin debonding layer between the mold and the top coat to facilitate the removal of the mold once the operation is completed.

In such a case, the method of the present invention would comprise the following steps:

(a) providing within a vacuum plasma spray chamber a re-usable mold made, for example, of stainless steel and having the shape of the internal surface of the component from which it may be withdrawn;

(b) vacuum plasma spraying on said mold a thin layer (up to about 100 $\mu$m) of a debonding material such as $ZrO_2$ (the debonding material may be the same as that used for the top coat, but sprayed under conditions which enable this layer to be detached from the mold at the completion of the operation);

(c) heating the surface of the debonding material to a predetermined temperature and vacuum plasma spraying thereon the top coat layer of predetermined thickness;

(d) heating the surface of the so produced top coat to a predetermined temperature and vacuum plasma spraying said top coat surface with a bond coat, for example of MCrAlY, such as CoNiCrAlY;

(e) maintaining the surface of the so produced bond coat at a predetermined temperature and vacuum plasma spraying thereon a layer of a structural superalloy, such as IN-738LC, to a predetermined thickness; and (f) cooling the structure so produced allowing the debonding layer to crack, and mechanically removing the mold from the component, which mold may then be re-used in a subsequent operation.

The mold is usually heated to a surface temperature of about 400° C.–700° C. prior to spraying the top coat layer thereon, however, if a debonding layer is first sprayed onto the mold, the mold is normally heated to a surface temperature below 400° C. when applying the debonding layer, although one may start applying such layer even when the mold has not been preheated, since the surface of the mold will be rapidly heated by the plasma torch used to apply the debonding layer. In order to maintain the mold at the desired temperature, the torch heating may be assisted using heat from another source, such as infrared lamps directed towards the mold, or when the mold is hollow, a heating coil may be placed within such hollow mold to provide additional heat when required.

Also, thermally insulate regions of the mold which do not require deposition, e.g. the two ends of the cylindrical mold used to form combustor liners, may be capped with ceramic prior to the VPS operation.

The ceramic top coat layer which may consist of a mixture of $ZrO_2$ and $Ca_2SiO_4$, is usually deposited to a thickness of between 250 μm and 1.5 mm depending on thermal barrier requirements. The porosity of the ceramic top coat is also normally controlled so as to maximize its thermal barrier properties. The most commonly employed top coat is $ZrO_2$ because it has a very low thermal conductivity, however, it cannot be deposited to thicknesses above about 250 μm because it will then have a tendency to spall. It has been found that admixtures of $ZrO_2$ with $Ca_2SiO_4$ obviate this problem and allow much thicker top coat deposits. Although $Ca_2SiO_4$ has about twice the thermal conductivity of $ZrO_2$, an admixture thereof with zirconia allows to increase the thickness of the top coat layer, and the higher the quantity of calcia-silica, the thicker the top coat layer that can be built-up.

Once the ceramic top coat layer has been produced, its surface is normally heated to about 700° C.–800° C. prior to applying the metallic bond coat, which is built-up to a thickness of between about 100 μm and 200 μm, typically about 150 μm. Then, after formation of the bond coat, whose surface temperature is maintained at about 700° C.–800° C., the metallic structural layer of e.g. IN-738LC superalloy is vacuum plasma sprayed to a thickness of between 1 and 5 mm.

It should be noted that it takes many passes of the plasma spray torch to achieve the desired thicknesses of the various layers. When spraying ceramic materials by VPS, one pass will usually deposit a thickness of between 5–50 μm and when spraying metals, one pass will achieve between 30–100 μm of thickness. Thus, it may take 10s of passes to build-up the TBC layers and 100s of passes to build-up the outer structural layer. However, all these passes and build-ups are made within the same overall operation in the vacuum plasma spray chamber, where the vacuum pressure and other operating parameters may also be suitably adjusted between the various steps. The control of the passes, their paths, speeds, etc. is normally done by a computerized robotic system.

The final step in the present VPS net-shape forming method is the cooling of the obtained structure and the removal of the mold from the produced multilayered component. After having performed the previous steps in a correct manner, the multilayered component, such as the combustor liner, will detach itself from the mold at the debonding layer during the cool down of the structure. It is at this point that the mold is removed mechanically from the near net-shape component. In cases of components with complex geometry, such as the transition duct, the mold is removed chemically or electrochemically by selecting a good etchant or electrolyte which will quickly disintegrate the mold material, but without affecting the VPS formed layers.

The resulting near net-shape formed multilayered component has a smooth thermal barrier coating as its inside surface and a good, strong structural layer for example of IN-738LC superalloy as its outer structure. Moreover, after its separation from the mold, the component may also be heat treated to further improve the mechanical properties of the structural layer or may be machined down to a smaller size of outer dimensions. Due to the use of smooth mold surface and of the VPS process, a very high smoothness of the inside surface may be achieved, normally less than 25 μm $R_Z$, which to applicants' knowledge is not achievable by any other process and is unknown in this type of components.

It should, moreover, be mentioned that the near net-shape forming of ceramic composite components by VPS is generally known. One such system is described in an article entitled "Near-Net Shape Forming of Ceramic Refractory Composite High Temperature Cartridges by VPS" by T. McKechnie et al., Proceedings of the 7th National Thermal Spray Conference Jun. 20–24, 1994, Boston, Mass, pages 457–461. Other articles of interest are: "Metallurgical and Process Comparison of Vacuum Plasma Spray Forming on Internal and External Surfaces" by T. N. McKechnie et al., Proceedings of the 1993 National Thermal Spray Conference, Anaheim, Calif., Jun. 7–11, 1993, pp 543–548; and "Mechanical Properties of Vacuum-Plasma Sprayed Titanium and Titanium Alloys" by H.-D. Steffens et al., Proceedings of the International Thermal Spray Conference & Exposition, Orlando, Fla., USA, May 28–Jun. 5, 1992, pp 369–374. However, near net-shape VPS forming has never been used to produce multilayered combustion system components including the outer structural layer, as set out in the present invention.

It should further be mentioned that when re-usable molds are employed, one of the important and novel features of the present invention is the embodiment providing for deposition of the debonding layer onto the mold. It has been found that without such debonding layer, it is difficult to separate the final component from the mold. Thus, the applicants have developed a novel procedure whereby a debonding layer is first vacuum plasma sprayed onto the mold, which significantly improves subsequent separation of the mold from the multilayered component. Such debonding layer plays two somewhat contrasting roles. One role is that this debonding layer should be sufficiently strong to provide enough adhesion between the mold and the top coat to allow for the build-up of the entire multilayered component, whereas the second role is that this debonding layer should be weak enough for allowing detachment or debonding of the mold from the final component upon subsequent cooling of the structure. The debonding layer is normally made of the same material as the top coat (or some similar compatible material that will satisfy the above requirements) and is vacuum plasma sprayed at a relatively low temperature (usually below 400° C.) with spray parameters that form a cooler and faster plasma jet. These spray conditions provide enough adhesion at the mold surface for the required build-up, but not high enough to maintain the bond during cool down. The difference in the coefficient of thermal expansion between the mold (high CTE) and the ceramic top coat (lower CTE) creates a tensile stress greater than the adhesive or cohesive bond strength at the debonding layer region leading to separation of the two.

Once the debonding layer has been applied to the mold, the latter is heated to a temperature of between about 400° C. and 700° C. prior to applying the top coat. This also plays two roles, one being an improved adhesion of the further deposits and the controlling of stress within the coatings at their interfaces, and the other being the expansion of the mold prior to build-up of the various layers, which facilitates removal of the mold when it contracts during the subsequent cool down.

BRIEF DESCRIPTION OF THE DRAWINGS

The invention will now be described with reference to the appended drawings in which.

DETAILED DESCRIPTION OF THE INVENTION

Figure 1:
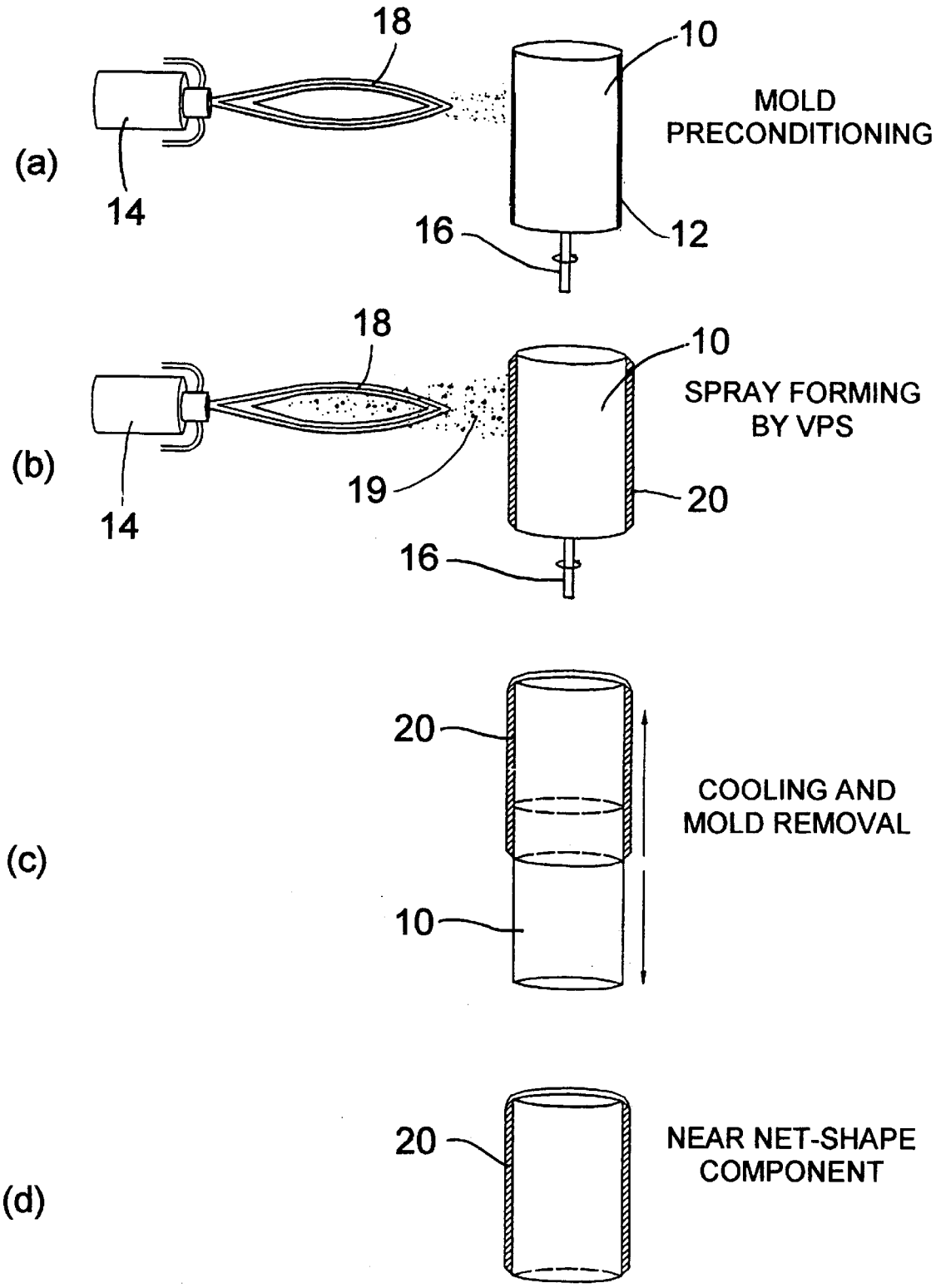
FIG. 1 is a schematic illustration of the steps of the method according to one embodiment of the present invention.

An embodiment of the method of the present invention with a re-usable mold is described herein with reference to FIG. 1 where in step (a) mold 10 is preconditioned by applying a thin debonding layer 12 thereto through vacuum plasma spraying of this debonding layer with the plasma torch 14. This is done at a relatively low temperature of less than 400° C. with 2–4 passes of the plasma jet 18 effected by rotation of the mold 10 using rotating means 16. Thereafter, the mold 10 is heated using jet 18 of the same plasma torch 14, to a temperature of between 400° C. and 700° C.

In step (b) the various layers of the multilayered component 20, starting with the inner TBC and ending with the outer structural layer are spray formed by VPS through successive deposits of such layers using plasma torch 14 emitting plasma jet 18 and various powders 19, while rotating the structure by rotating means 16 to successively deposit the multilayered component 20. The temperature and vacuum conditions as well as other spray parameters are adjusted as needed between deposition of the successive layers.

In step (c) the structure is cooled down and mold 10 is mechanically removed from the multilayered component 20 from which it can be readily separated due to the existence of debonding layer 12 deposited in step (a).

Finally, the near net-shape component 20 is obtained in step (d) where it can optionally be heat treated to improve the mechanical properties of the outer structural layer made, for instance, of Inconel or IN-738LC superalloy, and/or it can be machined down to a smaller size.

If, unlike the cylindrical mold shown in FIG. 1, the mold has a complex geometry such as that of the transition duct, the mold can then be made of a soft metal, such as copper, and no deposition of the debonding layer is required in step (a) where the mold is simply heated to the desired temperature of between 400° C.–700° C. In step (c) such mold is removed by disintegration via chemical or electrochemical means as already mentioned previously.

Figure 2:
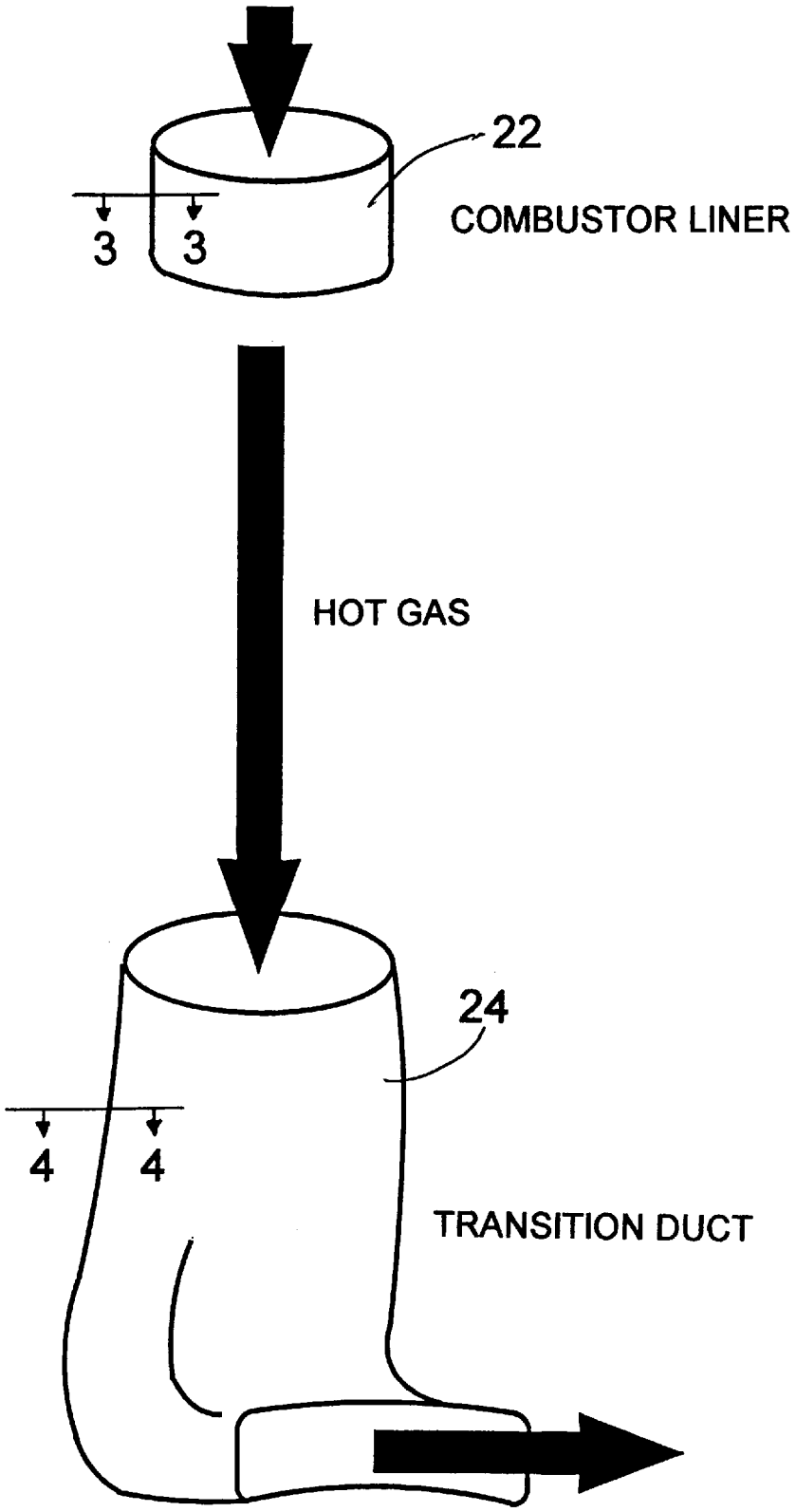
FIG. 2 is an illustration of a combustor liner and a transition duct arrangement of a gas turbine engine that may be produced by the method of the present invention.

FIG. 2 illustrates an arrangement of a combustor liner 22 and a transition duct 24 and shows by a thick arrow the passage of the hot gas therethrough. In fact, in a turbine, between the combustor liner 22 and the transition duct 24, there are normally provided additional combustor liners forming the so called combustor basket. The compressor discharge air is mixed with the fuel combusted near the top of the combustor basket. The basket is designed to contain the flame, to mix-in diluent air, to control temperature emissions and smoke, to channel the hot gases into the turbine, and to provide for air cooling of the metal walls. The combustor liner 22 and the transition duct 24 have been near net-shape formed by VPS in accordance with the present invention and have a multilayered structure shown in cross-section in FIG. 3 for the combustor liner made with a re-usable mold and in FIG. 4 for the transition duct made with a destructible mold.

Figure 3:
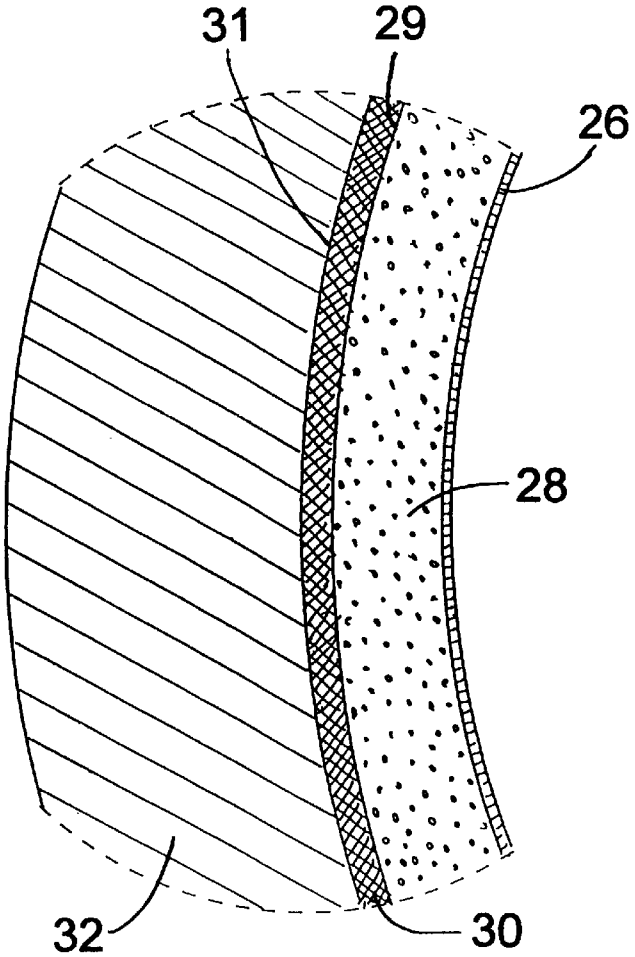
FIG. 3 is a view of cross-section 3—3 in FIG. 2, showing a schematic illustration of the various layers of a combustor liner component, including a portion of the debonding layer.

Thus, in FIG. 3 the cross-section shows a thin remainder of the debonding layer 26 left after removal of the mold. It is usually made of a ceramic material, such as $ZrO_2$, and is ~0.01 mm in thickness. It effectively becomes part of the ceramic top coat 28, since it is generally made of the same material as the top coat, except that it is sprayed onto the mold at a lower surface temperature than the top coat, namely with the surface temperature of the mold being about 300° C.–400° C., although the spraying may begin without pre heating the mold. Then, top coat 28 is sprayed onto the debonding layer 26 after heating said debonding layer to a temperature between 400° C. and 700° C. The top coat 28 may, for example, be made of $ZrO_2$—$Ca_2SiO_4$ admixture and normally has a thickness >1 mm.

Following the deposition of the ceramic top coat 28, a metallic bond coat 30 is sprayed thereon after heating the surface 29 of the top coat 28 to a temperature of between about 700° C. and 800° C. This bond coat 30 may, for example, be made of CoNiCrAlY alloy and has a thickness of ~0.15 mm. Once this bond coat 30 has been deposited, its surface 31 is preheated to or maintained at a temperature between about 700° C. and 800° C. and a structural layer 32 is then sprayed thereon. This structural layer 32 may be made, for instance, of superalloy IN-738LC and has a thickness of, for example, 1–5 mm.

Figure 4:
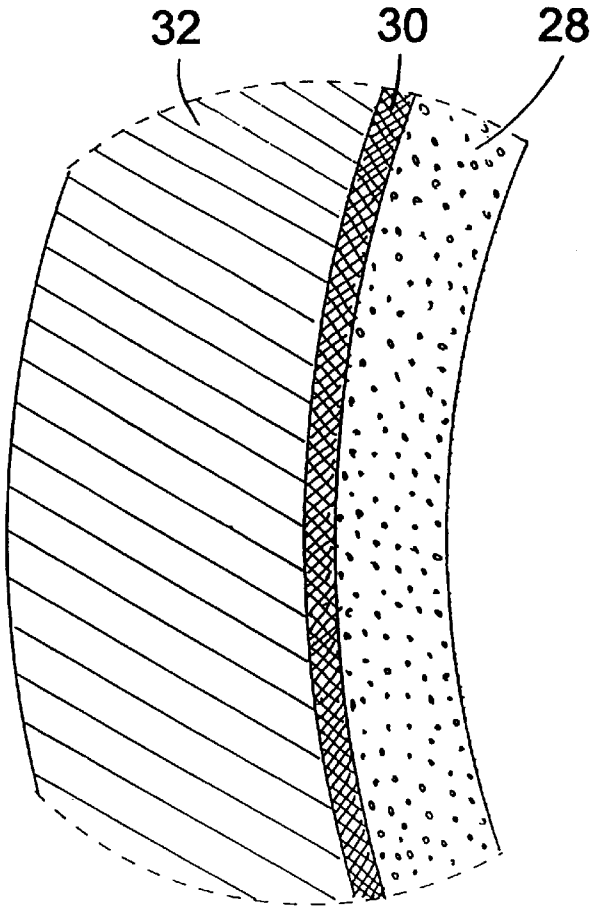
FIG. 4 is a view of cross-section 4—4 in FIG. 2, showing a schematic illustration of the various layers of a transition duct component without the debonding layer.

FIG. 4 illustrates a structure similar to that of FIG. 3, but made using a destructible mold, for instance made of copper, which is later removed by destroying it through chemical or electrochemical means. Thus, in this case, no initial debonding layer is applied, but rather the top coat 28 is directly applied to a mold preheated between 400° C. and 700° C. Then, bond coat 30 and structure layer 32 are successively applied as already described with reference to FIG. 3. It should be mentioned that additional desired layers or coatings, including reinforcing fibers, may be incorporated into the structure without departing from the spirit and scope of the present invention that enables to produce near net-shape formed multilayered combustion system components by VPS from inside out, i.e. by consecutively depositing desired layers of materials onto a mold, including the final structural layer, in a single overall operation and then removing the mold upon cool down.

EXAMPLE

This example illustrates the fabrication of a combustor liner according to the present invention.

A mold of stainless steel 304 was used for this example. The outer diameter of the mold was machined so as to achieve a near net-shape of the inner diameter of the desired combustor liner, taking into account the mold expansion factor (determined from previous trials). In this case, it was machined so as to achieve a combustor liner of 18 cm internal diameter.

The mold surface was grit blasted and ultrasound cleaned prior to its introduction into the VPS chamber. Upon closing the chamber door, the system was pumped down to $6\times10^{-3}$ mbar.

The following procedures were then carried out:

increase chamber pressure to 70 mbar, by introducing argon gas;

spray 4 passes of zirconia (40–60 $\mu$m thick) [debonding layer];

shut off powder flow;

decrease pressure to 60 mbar;

heat surface with torch to 620° C.;

increase pressure to 150 mbar;

spray 22 passes of calcia-silica and zirconia combinations (750 $\mu$m) [top coat layer];

shut off powder flow;

decrease pressure to 70 mbar;

heat surface to 780° C.;

spray 4 passes of CoNiCrAlY (80–100 μm) [bond coat layer];

shut off powder flow;

decrease pressure to 60 mbar;

spray 200 passes of IN-738LC (5 mm) [structural superalloy layer]; and shut off powder flow and allow to cool in vacuum.

Upon cooling of the component, the spray formed part was physically removed from the mold. The part had an overall wall thickness of approximately 6.4 mm, and an inside surface roughness of approximately 19.1 μm $R_2$. The structural superalloy layer was then machined down to achieve an overall wall thickness of 4.5 mm.

It should be mentioned that cylindrical combustor liners are used in can-type combustors. Several combustor liners are arranged around the engine, with the can axis more or less parallel to the shaft. Primary combustion air and fuel are injected at one end of the can and combust. Some of the primary combustion air flows over the outside of the liner and enters through nozzles downstream. Secondary and tertiary air, passes over the outside of the primary combustor liner, thus providing some cooling.

Combustor liners undergo abrupt temperature fluctuations resulting in low cycle fatigue (LCF); the combustion process generates high-frequency vibrations which can also induce high cycle fatigue (HCF) failures. The relatively thin walls of the conventional liners (~2 mm) make oxidation of the structural alloy a concern. The pressure outside the combustor liner is higher than the inside, which enables the secondary and tertiary air flow through the wall perforations. This difference in pressure, in combination with the thin-nature of the liner wall, may lead to creep problems for the component. The weld in the liner wall and the roughness of its internal surface also represent problems that have already been discussed above.

Through the new near net-shape VPS forming process of the present invention, a combustor liner with a thicker, more uniform, and smoother TBC can be fabricated to better resist the low cycle fatigue, high cycle fatigue, oxidation, and creep. Other improvements include: better superalloy material for structural layer; exclusion of welding from the fabrication process; and lower temperature exposure of superalloy.

Although the above non-limitative example relates to the fabrication of a combustor liner, other combustion system components can be so fabricated employing either re-usable or destructible molds. It should also be noted that various modifications obvious to a person skilled in the art can be made without departing from the spirit of this invention and the scope of the following claims.

What is claimed is:

1. A vacuum plasma spray formed near net-shape combustion systems component, comprising:

(a) an inner ceramic top coat having a uniform thickness and a smooth inside surface;

(b) an intermediate metallic bond coat of MCrAlY, where M is Ni, Co, Fe or a combination thereof, having a thickness which is smaller than that of the ceramic top coat; and (c) an outer structural superalloy layer having a thickness which may vary within the component, being capable of withstanding temperatures in excess of 700° C., said outer structural layer having no seems or welds of any kind therein.

2. A component as claimed in claim 1, wherein the ceramic top coat is selected from the group consisting of zirconia, calcia-silica and a combination thereof.

3. A component as claimed in claim 2, wherein zirconia is partially stabilized with yttria.

4. A component as claimed in claim 1, wherein the ceramic top coat has a thickness greater than 250 μm.

5. A component as claimed in claim 1, wherein the smooth inside surface of the ceramic top coat has a roughness of less than 25 μm $R_Z$.

6. A component as claimed in claim 1, wherein the intermediate bond coat consists of CoNiCrAlY and has a thickness of between about 100 μm and 200 μm.

7. A component as claimed in claim 1, wherein the structural superalloy is a nickel-base or cobalt-base superalloy having good structural and thermal resistance properties.

8. A component as claimed in claim 1, wherein the structural superalloy layer has a thickness of between about 1 mm and 5 mm.

9. A component as claimed in claim 1, wherein the component is a combustor liner or a transition duct of a gas turbine engine.

10. A component as claimed in claim 1, wherein the ceramic top coat has a thickness of between about 1 mm and 1.5 mm.

* * * * *

UNITED STATES PATENT AND TRADEMARK OFFICE
CERTIFICATE OF CORRECTION

PATENT NO : 6,087,023
DATED : July 11, 2000
INVENTOR(S) : Tsantrizos et al.

It is certified that error appears in the above-identified patent and that said Letters Patent are hereby corrected as shown below:

On the title page: Item [73]

"Progenesis Inc." should read -- Pyrogenesis Inc. --

Signed and Sealed this

Tenth Day of April, 2001

*Attest:*

Nicholas P. Godici

NICHOLAS P. GODICI

*Attesting Officer*

*Acting Director of the United States Patent and Trademark Office*